US006443706B1

(12) United States Patent
Deininger et al.

(10) Patent No.: US 6,443,706 B1
(45) Date of Patent: Sep. 3, 2002

(54) HYDROSTATIC AXIAL PISTON MACHINE WITH ELECTRO-HYDRAULIC SWASH PLATE CONTROL

(75) Inventors: Horst Deininger, Hörstein-Alzenau; Eckehart Schulze, Weissach, both of (DE)

(73) Assignee: Linde Aktiengesellschaft (DE)

( * ) Notice: Subject to any disclaimer, the term of this patent is extended or adjusted under 35 U.S.C. 154(b) by 0 days.

(21) Appl. No.: 09/724,113

(22) Filed: Nov. 28, 2000

Related U.S. Application Data

(63) Continuation of application No. 08/811,100, filed on Mar. 3, 1997, now Pat. No. 6,155,798.

(30) Foreign Application Priority Data

Mar. 4, 1996 (DE) ..... 196 08 228

(51) Int. Cl.[7] ..... F04B 1/26

(52) U.S. Cl. ..... 417/222.1; 417/218; 92/71; 92/12.2

(58) Field of Search ..... 417/222.1, 218; 92/71, 12.2; 91/505, 506

(56) References Cited

U.S. PATENT DOCUMENTS

| | | | | | |
|---|---|---|---|---|---|
| 3,733,970 A | | 5/1973 | Bosch | ..... | 417/217 |
| 3,803,843 A | * | 4/1974 | Nyman et al. | ..... | 60/19 |
| 3,905,274 A | * | 9/1975 | Week et al. | ..... | 91/506 |
| 3,974,715 A | | 8/1976 | Habiger | ..... | 74/571 |
| 4,355,506 A | * | 10/1982 | Leonard | ..... | 60/389 |
| 4,426,911 A | * | 1/1984 | Robinson et al. | ..... | 91/499 |
| 4,860,540 A | * | 8/1989 | Hayashi et al. | ..... | 91/506 |
| 5,066,201 A | | 11/1991 | Nagai et al. | ..... | 417/222.1 |
| 5,611,675 A | * | 3/1997 | Uchida et al. | ..... | 417/270 |
| 6,048,176 A | * | 4/2000 | Deininger | ..... | 417/222.1 |

FOREIGN PATENT DOCUMENTS

| | | | |
|---|---|---|---|
| JP | 410331773 | 12/1998 | ..... 417/370 |

* cited by examiner

*Primary Examiner*—Cheryl J. Tyler
(74) *Attorney, Agent, or Firm*—Webb Ziesenheim Logsdon Orkin & Hanson, P.C.

(57) ABSTRACT

A hydrostatic axial piston machine employs a swash plate construction in which the diagonal position of the swash plate can be controlled by at least one positioning piston pressurized with a control pressure. A control valve is in a line which leads to at least one positioning piston. A simple electrical-hydraulic control of the swash plate can be accomplished by the electrical actuation of the control valve. The control valve may be in the form of a rotary disk valve which can be actuated by a stepper motor.

12 Claims, 3 Drawing Sheets

HYDROSTATIC AXIAL PISTON MACHINE WITH ELECTRO-HYDRAULIC SWASH PLATE CONTROL

This application is a continuation of U.S. patent application Ser. No. 08/811,100, filed Mar. 3, 1997 now U.S. Pat. No. 6,155,798.

BACKGROUND OF THE INVENTION

1. Field of the Invention

This invention relates to a hydrostatic axial piston machine having a swash plate construction. Specifically, the present invention relates to a construction in which the swash plate position can be set by at least one positioning piston pressurized with control pressure, and where a control valve is in a line leading to the positioning piston.

2. Background Information

Axial piston machines are used primarily as hydraulic pumps in hydraulic systems. During operation of these machines, it is advantageous if the displacement volume adapts to different operating conditions by changing the diagonal position of the swash plate. For this purpose, known devices normally use mechanical or hydraulic control devices which are mechanically, hydraulically or electrically actuated.

Known hydraulic control devices have at least one positioning piston engaged with the swash plate to determine the swash plate position. This will determine the displacement volume. A control valve is located in a leading to the positioning piston to generate a control pressure operating the piston.

Electrically actuated control devices have been used to improve the control and regulation of the displacement volume adjustment. Known systems have provided a proportional valve actuated by a proportional magnet.

The proportional magnet converts an electrical control signal into a magnetic force to actuate a pressure reducing valve which moves against a spring force. The pressure reducing valve is connected to a pressure source and generates a pilot pressure as a function of the actuation. The pilot pressure displaces a spring-activated pilot piston. The travel is transmitted by an intermediate mechanical element to a control valve located on the swash plate. The pilot piston actuates the control valve mechanically. The control valve generates a control pressure from a supply pressure. The positioning piston of the hydraulic adjustment device is pressurized with the control pressure. The swash plate position is thereby adjusted. A mechanical linkage transmits the travel back to the control valve to close the valve when the swash plate reaches the desired position.

To generate the pivoting angle of the swash plate by the electrical control signal, the known systems require five conversions in the signal transmission path. Each of these conversions is subject to varying tolerances and requires physical components. Friction occurs in some of the components which is reflected in the form of hysteresis. With the control valve located directly on the swash plate, the lines leading to the positioning piston are more complex and more expensive to construct.

The object of this invention is to make an electric-hydraulic control for the swash plate which has a simple construction.

SUMMARY OF THE INVENTION

The above objects can be accomplished by electrical actuation of the control valve according to the present invention. In the present invention, an electrical control signal is converted into a swash plate position with a minimum of intermediate elements.

The electrical control signal directly actuates the control valve which controls the control pressure to the positioning piston. The control valve actuation produces the control pressure which, through the positioning piston, results in the desired diagonal position of the swash plate. With direct actuation of the control valve, the signal transmission path requires only three conversions from the electrical control signal to the desired swash plate position.

In one preferred embodiment, the control valve is actuated by a stepper motor. The electrical signal for the actuation of the stepper motor consists of counting pulses which are converted, independently of friction factors, into the angular displacement of the output shaft of the stepper motor.

The control valve may be a rotary disk valve which pressurizes the positioning piston with control pressure. A rotary disk valve actuated by the stepper motor represents a simple way to generate the control pressure on control edges of the rotary disk valve.

The rotary disk valve may have a rotating control shaft including at least one groove which can be pressurized with supply pressure and with tank pressure. A rotating sleeve surrounds the control shaft on the outside periphery thereof with grooves in the rotary sleeve for the pressurization of the positioning piston with tank pressure or control pressure. Control pressure is exerted on the positioning piston or the positioning piston is pressurized with the tank pressure by changing the angle of rotation of the control shaft relative to the sleeve.

The positioning piston may be a double-acting cylinder or a plurality of single-action cylinders located, for example, on both sides of a swivelling axis of the swash plate. In the first case, the grooves of the sleeve are connected to the piston chamber and the cylinder chamber of the double-acting cylinder. In the latter case, one of each type of groove is connected to the piston chamber of a cylinder. In this embodiment of the rotary disk valve, the function of the control shaft and the sleeve can be exchanged by connecting the grooves in the sleeve to the supply pressure and tank pressure and providing the grooves of the control shaft for the pressurization of the positioning piston.

One of the two rotating components of the rotary disk valve may be non-rotationally connected to the stepper motor output shaft. The electrical input signal is thereby converted directly into an angle of rotation of the rotary disk valve and generates the control pressure for the positioning piston.

The additional rotating component of the rotary disk valve may be engaged with the swash plate. This arrangement creates a correspondence between the displacement of the stepper motor output shaft and the diagonal position of the swash plate in a simple manner. The positioning piston is pressurized with control pressure only as long as there is a difference regarding the angle of rotation of the two components in the rotary disk valve.

The stepper motor output shaft, or the component of the rotary disk valve which is non-rotationally connected to the output shaft of the stepper motor, may be effectively connected to a device which places the output shaft in a neutral position. This guarantees that the stepper motor output shaft and the corresponding component of the rotary disk valve are pulled back into the neutral position, e.g., in the event of a power failure, and then the swash plate will pivot into the neutral position.

Furthermore, the stepper motor output shaft, or the component of the rotary disk valve, which is non-rotationally connected to the stepper motor output shaft, may be connected to a device which monitors the angle of rotation and/or the neutral position of the output shaft. It is thereby possible to monitor the angle of rotation and/or the neutral position of the output shaft if the stepper motor does not convert electrical counting pulses into a rotational movement of the rotary disk valve. It is thereby possible to correct the neutral position in safety routines.

In one embodiment of the invention, a mechanical transmission may be located between the swash plate and the rotational component of the rotary disk valve which is connected to the swash plate. This configuration can change the translation ratio between the angle of rotation of the stepper motor output shaft and the swash plate position. For example, if an increased translation is selected on the mechanical transmission between the swash plate position and the angle of rotation of the rotary disk valve, a desired displacement at the swash plate will be reflected by a correspondingly greater angle of rotation of the rotary disk valve. This arrangement makes possible a rapid adjustment of the swash plate with a high degree of accuracy. The dimensions of the rotary disk valve and the stepper motor may be reduced, if necessary.

In one embodiment, the stepper motor output shaft is non-rotationally connected to the rotational control shaft of the rotary disk valve, and the sleeve of the rotary disk valve is engaged with the swash plate. This configuration provides a simple construction of the axial piston adjustment device.

The rotary disk valve and the stepper motor can be located separately from the swash plate on the housing of the axial piston machine. This can significantly reduce the complexity and cost of the control pressure lines leading to the positioning piston. The longitudinal axis of the rotary disk valve may be perpendicular to the axis of rotation of the axial piston machine and, if necessary, may be aligned with or parallel to the pivoting axis of the swash plate.

In one embodiment of the invention, the stepper motor and the rotary disk valve are oriented parallel to the axis of rotation of the axial piston machine. This arrangement results in a significant reduction of the overall dimensions and in significant reduction of the height of the axial piston machine.

A complete understanding of the invention will be obtained from the following description when taken in connection with the accompanying drawing figures wherein like reference characters identify like parts throughout.

DESCRIPTION OF THE PREFERRED EMBODIMENTS

Figure 1:
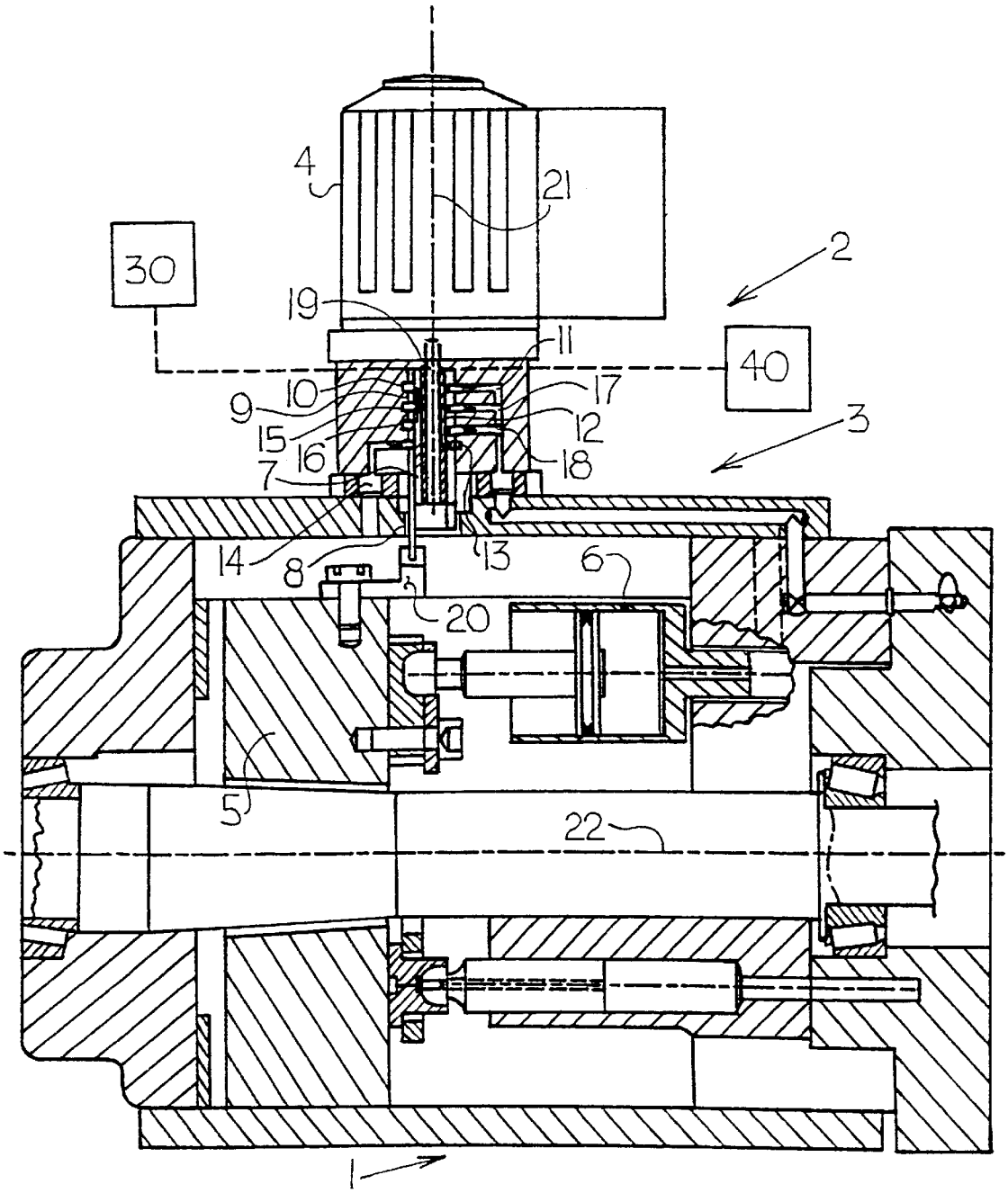
FIG. 1 shows a cross section through an axial piston machine according to the present invention.

FIG. 1 shows an axial piston machine 1 with an electrically actuatable control valve 2 according to the present invention. The invention includes a control valve, which is shown as rotary disk valve 3, which can be actuated by a stepper motor 4. The diagonal position of the swash plate 5 can be adjusted by a plurality of positioning pistons 6 which is located on both sides of a pivoting axis of the swash plate 5.

The rotary disk valve 3 contains a rotatable control shaft 7 and a rotatable sleeve 8 which surrounds the control shaft 7 on the outside periphery thereof. On the control shaft 7 there is a groove 9 which can be pressurized with a supply pressure supplied by an auxiliary pump 32, through a ring-shaped groove 10 located on the sleeve 8 and a supply pressure line 11. A groove 12, which is axially offset from the groove 9, is connected to the housing of the axial piston machine 1 by a ring-shaped groove 13 located on the sleeve 8 and a line 14.

There are two additional ring-shaped grooves 15, 16 on the sleeve 8. The grooves 15 and 16 can be connected to the grooves 9, 12 which are located on the control shaft 7, and each of which can be connected to the positioning pistons 6 by lines 17 and 18, respectively.

In the illustrated embodiment, the output shaft 19 of the stepper motor 4 is non-rotationally connected to the control shaft 7 of the rotary disk valve 3.

Located on the swash plate 5 is a component 20 which is non-rotationally connected to the sleeve 8. The rotary disk valve 3 and the stepper motor 4 are located on the housing of the axial piston machine 1.

In the embodiment illustrated in FIG. 1, the rotary disk valve 3 is oriented so that the longitudinal axis 21 of the stepper motor 4 and of the rotary disk valve 3 runs perpendicular to an axis of rotation 22 of the axial piston machine 1 and is aligned with the pivoting axis of the swash plate 5. In this embodiment, the angle of rotation set by the stepper motor 4 on the rotary disk valves corresponds to the pivoting angle of the swash plate 5 with reference to its pivoting axis.

Figure 2:
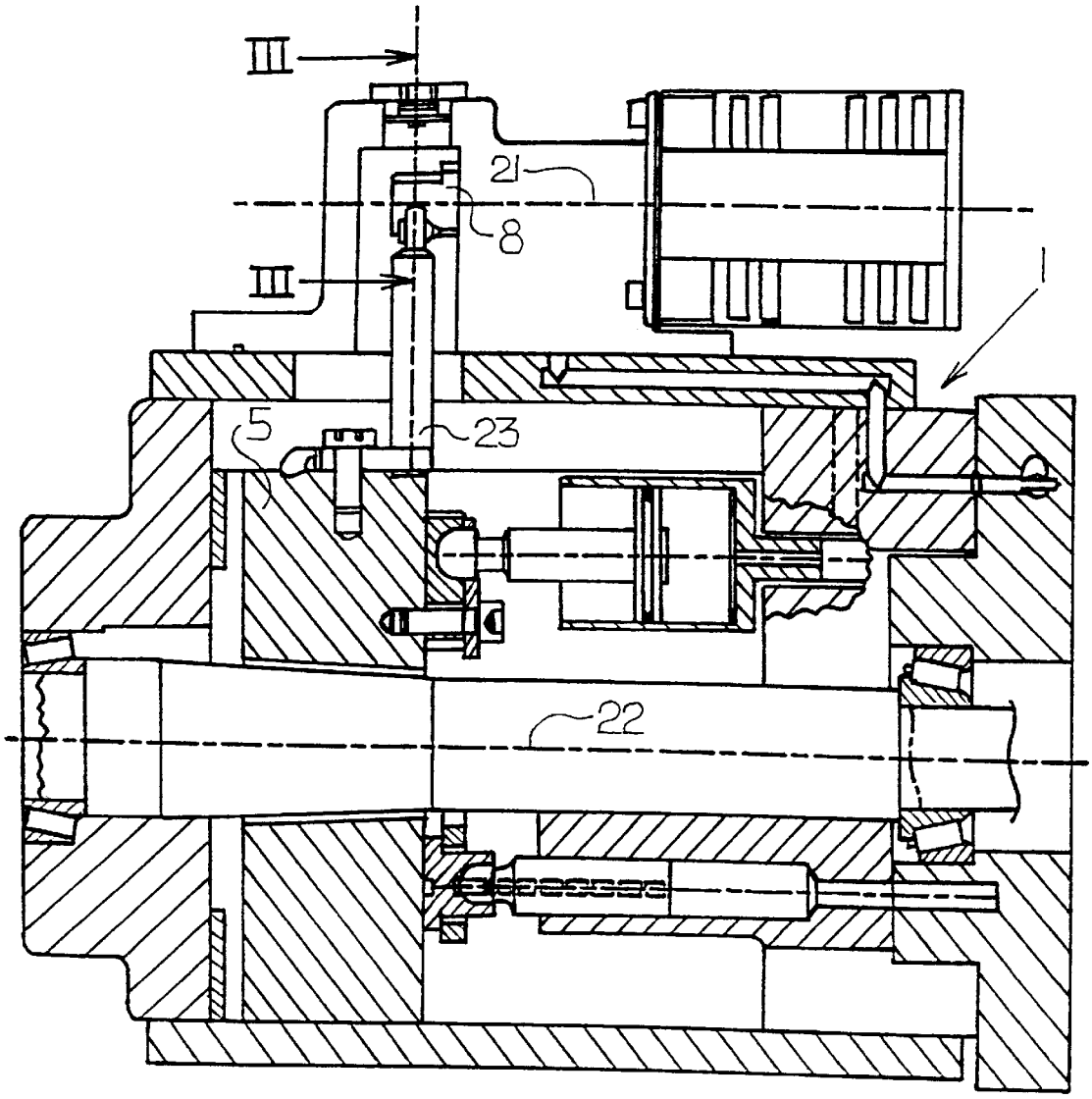
FIG. 2 illustrates an additional embodiment of the present invention.

The embodiment of the invention illustrated in FIG. 2 consists of an arrangement in which the longitudinal axis 21 of the stepper motor and of the rotary disk valve is parallel to the axis of rotation 22 of the axial piston machine 1. For purposes of simplification in the following description, the components illustrated in FIG. 2 are identified by the same reference numbers as the identical components in FIG. 1. Fastened to the swash plate 5 is a transmission component 23 which is connected to the sleeve 8 of the rotary disk valve 3.

Figure 3:
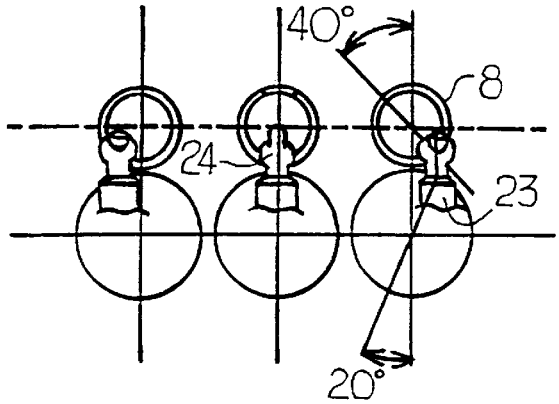
FIG. 3 shows a section along line III—III in FIG. 2.

As shown in FIG. 3, the transmission component 23 includes a spherical-shaped end in the vicinity of the rotary disk valve 3 and is connected to the sleeve 8 of the rotary disk valve 3 by a groove-shaped recess 24. In this embodiment, there is also a translation ratio in the range of 1:2 between the diagonal position of the swash plate 5 and the angle of rotation of the rotary disk valve 3. Therefore, as a function of the transmission ratio, an angle of rotation of 40° of the rotary disk valve 3 corresponds to a displacement of the swash plate 5 by 20°.

Figure 4:
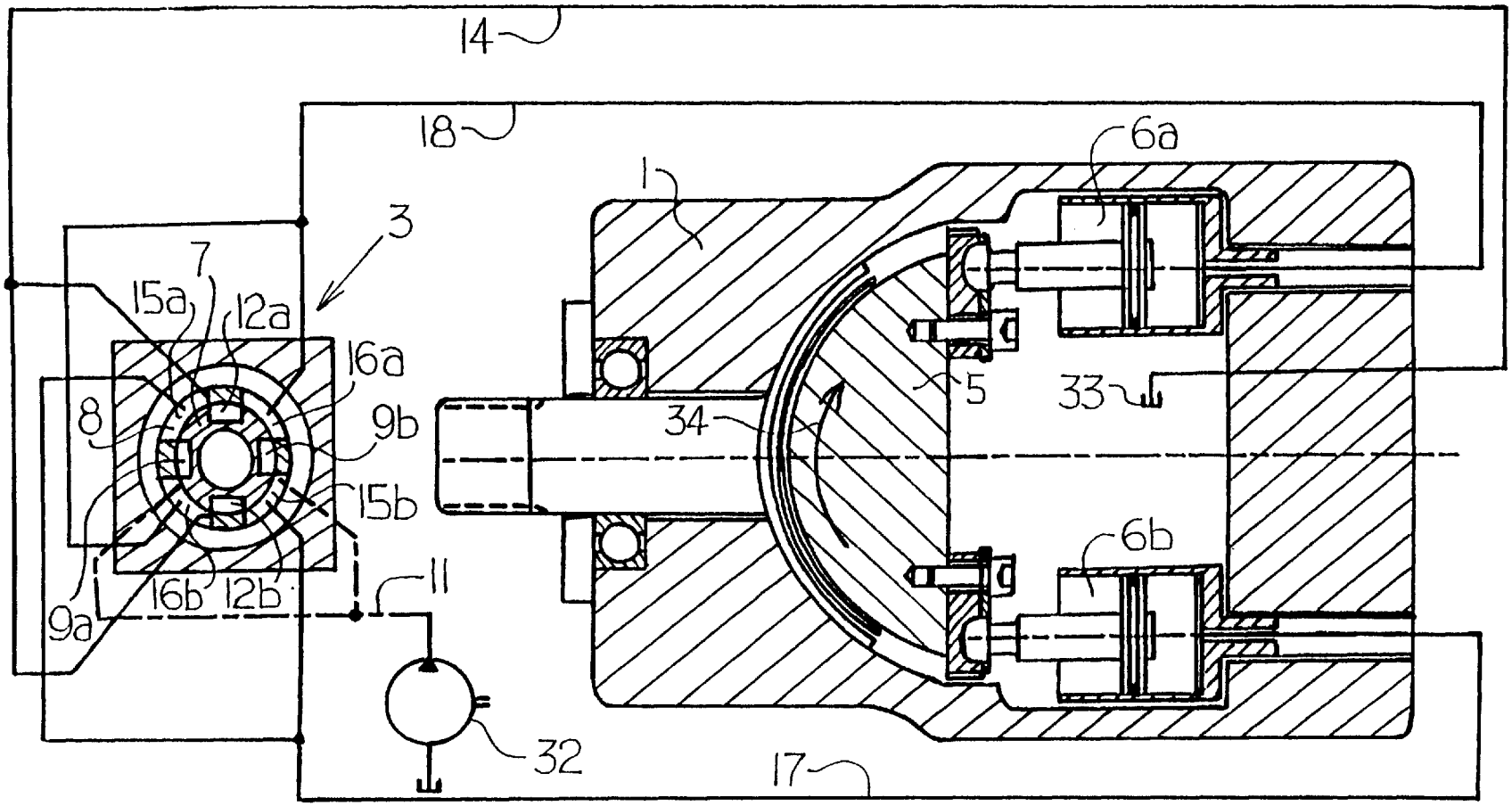
FIG. 4 is a circuit diagram of a control valve of the present invention.

FIG. 4 illustrates one possible circuit diagram of the control valve.

The control shaft 7 of the rotary disk valve 3 has two grooves 9*a*, 9*b* which are offset from one another by 180° and which are pressurized with a supply pressure generated by the auxiliary pump 32 through the line 11. Offset by 90° from the grooves 9*a* and 9*b*, there are an additional two grooves 12*a*, 12*b*, which are connected by the line 14 with a tank 33 or with the housing of the axial piston machine 1.

The sleeve 8 of the rotary disk valve 3 has two grooves 15*a*, 15*b* and two grooves 16*a*, 16*b* which are offset from one another by 180°, and which are connected by lines 17 and 18 with the positioning pistons 6*a*, 6*b* which are located on either side of the pivoting axis of the swash plate 5.

To adjust the position of the swash plate 5, an electrical input signal is formed by counting pulses. The input signal is converted in the stepper motor 4 to an angle of rotation of the output shaft 19 and of the control shaft 7 of the rotary disk valve 3 which is non-rotationally connected to the output shaft 19. The angle of rotation of the control shaft 7 corresponds to the number of counting pulses. If the control shaft 7 is moved in the clockwise direction as shown in FIG. 4, for example, control pressure flows from the auxiliary pump 32 through the line 11 and the grooves 9*a* and 9*b* into the groves 15*a* and 15*b* and thus via the line 17 into the piston chamber of the positioning piston 6*b*. Simultaneously, a connection is created between the positioning piston 6*a* and a tank 33 via the line 18, the grooves 16*a* and 16*b*, the grooves 12*a* and 12*b* and the line 14. The swash plate 5 thereby pivots in the direction 34. As a result of the mechanical coupling of the sleeve 8 of the rotary disk valve 3 and the swash plate 5, by the components 20 and 23 illustrated in FIG. 1 and FIG. 2, respectively, the sleeve 8 is simultaneously rotated as a function of the position of the swash plate 5, and when it has reached the desired position of the swash plate 5, closes the control edges on the rotary disk valve 3.

The stepper motor output shaft 19 may be effectively connected to a device 30, shown schematically in FIG. 1, which places the output shaft in a neutral position. This guarantees that the stepper motor output shaft 19 and the corresponding component of the rotary disk valve 3 are pulled back into the neutral position, e.g., in the event of a power failure, and then the swash plate 5 will pivot into the neutral position.

Furthermore, the stepper motor output shaft may be connected to a device 40, shown schematically in FIG. 1, which monitors the angle of rotation and/or the neutral position of the output shaft. It is thereby possible to monitor the angle of rotation and/or the neutral position of the output shaft 19, if the stepper motor 4 does not convert electrical counting pulses into a rotational movement of the rotary disk valve 3. It is thereby possible to correct the neutral position in safety routines. It is anticipated that the control shaft 7, which is connected to the output shaft 19 could alternatively be connected to device 30 and/or device 40.

While the invention is described in detail herein, it will be appreciated by those skilled in the art that various modifications and alternatives to the arrangements can be developed in light of the overall teachings of the disclosure. Accordingly, the particular arrangements are illustrative only and are not limiting as to the scope of the invention which is to be given the full breadth of the appended claims and any and all equivalents thereof.

What is claimed is:

1. A hydrostatic axial piston machine comprising:

a pivotable swash plate;

at least one positioning piston for setting the diagonal position of said swash plate;

an electrically activated control valve for controlling said at least one positioning piston, wherein said electrically activated control valve is a rotary disk valve having a rotatable control shaft and a rotating sleeve surrounding said control shaft; and a stepper motor activating said electrically activated control valve, wherein one of said control shaft and said rotating sleeve of said rotary disk valve is non-rotationally connected to an output shaft of said stepper motor and the other of said control shaft and said rotating sleeve of said rotary disk valve is connected to said swash plate, wherein said rotary disk valve has at least one groove in said control shaft which is pressurized with supply pressure and one groove in said rotatable shaft which is pressurized with tank pressure, and wherein said rotary disk valve has a plurality of grooves in said rotating sleeve to pressurize said at least one positioning piston with tank pressure or control pressure.

2. The hydrostatic axial piston machine as claimed in claim 1, wherein an output shaft of said stepper motor is coupled to a device which moves said output shaft into a neutral position.

3. The hydrostatic axial piston machine as claimed in claim 2, wherein said output shaft of said stepper motor is coupled to a device which monitors at least one of the angle of rotation and the zero position of said output shaft.

4. The hydrostatic axial piston machine as claimed in claim 3, wherein there is a mechanical transmission between said rotary disk valve and said swash plate.

5. The hydrostatic axial piston machine as claimed in claim 4, wherein said rotary disk valve and said stepper motor are located on a housing of said axial piston machine.

6. The hydrostatic axial piston machine as claimed in claim 5, wherein a longitudinal axis of said rotary disk valve and of said stepper motor is oriented perpendicular to an axis of rotation of said axial piston machine and parallel to a pivoting axis of said swash plate.

7. The hydrostatic axial piston machine as claimed in claim 5, wherein a longitudinal axis of said rotary disk valve and of said stepper motor is oriented parallel to the axis of rotation of said axial piston machine.

8. A hydrostatic axial piston machine comprising:

a pivotable swash plate;

at least one positioning piston for setting the diagonal position of said swash plate, wherein said at least one positioning piston is adapted to be pressurized with control pressure; and an electrically activated control valve connected to a line which leads to said at least one positioning piston, wherein said control valve is a rotary disk valve which pressurizes said at least one positioning piston with control pressure, and wherein a longitudinal axis of said rotary disk valve is perpendicular to said axis of rotation of said axial piston machine, wherein said rotary disk valve has a rotatable control shaft with at least one groove in said control shaft which is pressurized with supply pressure and one groove in said rotatable shaft which is pressurized with tank pressure, and wherein said rotary disk valve has a plurality of grooves in said rotating sleeve to pressurize said at least one positioning piston with tank pressure or control pressure.

9. The hydrostatic axial piston machine as claimed in claim 8, wherein an output shaft of said stepper motor is coupled to a device which moves said output shaft into a neutral position.

10. The hydrostatic axial piston machine as claimed in claim 9, wherein said output shaft of said stepper motor is coupled to a device which monitors at least one of the angle of rotation and the zero position of said output shaft.

11. The hydrostatic axial piston machine as claimed in claim 10, wherein there is a mechanical transmission between said rotary disk valve and said swash plate.

12. The hydrostatic axial piston machine as claimed in claim 11, wherein said rotary disk valve and said stepper motor are located on a housing of said axial piston machine.

* * * * *

UNITED STATES PATENT AND TRADEMARK OFFICE

CERTIFICATE OF CORRECTION

PATENT NO. : 6,443,706 B1
DATED : September 3, 2002
INVENTOR(S) : Horst Deininger et al.

It is certified that error appears in the above-identified patent and that said Letters Patent is hereby corrected as shown below:

Column 1,
Line 30, "in a leading" should read -- in a line leading --.

Signed and Sealed this

Eighteenth Day of February, 2003

JAMES E. ROGAN
*Director of the United States Patent and Trademark Office*